US006273977B1

(12) United States Patent
Harden et al.

(10) Patent No.: US 6,273,977 B1
(45) Date of Patent: Aug. 14, 2001

(54) METHOD AND APPARATUS FOR MAKING THERMALLY BONDED ELECTRICAL CABLE

(75) Inventors: Scott W. Harden; David R. Harden, both of Washington, PA (US)

(73) Assignee: Cable Design Technologies, Inc., Washington, PA (US)

( * ) Notice: Subject to any disclaimer, the term of this patent is extended or adjusted under 35 U.S.C. 154(b) by 0 days.

(21) Appl. No.: 08/428,790

(22) Filed: Apr. 13, 1995

(51) Int. Cl.[7] ..... H01B 13/14

(52) U.S. Cl. ..... 156/51; 156/244.12; 156/244.27; 174/117 F

(58) Field of Search ..... 156/51, 244.12, 156/309.6, 244.11, 244.27; 174/117 F

(56) References Cited

U.S. PATENT DOCUMENTS

| | | | | |
|---|---|---|---|---|
| 2,204,782 | * | 6/1940 | Wermine | 156/244.12 |
| 3,996,033 | | 12/1976 | Chickowski . | |
| 4,221,756 | | 9/1980 | Piper et al. . | |
| 4,368,214 | | 1/1983 | Gillette . | |
| 4,473,716 | | 9/1984 | Jesseman . | |
| 4,683,349 | | 7/1987 | Takebe . | |
| 4,783,579 | | 11/1988 | Brandolf et al. . | |
| 5,015,800 | * | 5/1991 | Vaupotic et al. | 156/51 |
| 5,213,644 | | 5/1993 | Phillips et al. . | |
| 5,327,513 | | 7/1994 | Nguyen et al. . | |
| 5,334,271 | * | 8/1994 | Bullock et al. | 156/244.12 |
| 5,606,151 | | 2/1997 | Siekierka et al. . | |

* cited by examiner

*Primary Examiner*—Michael W. Ball
*Assistant Examiner*—Michael A. Tolin
(74) *Attorney, Agent, or Firm*—Paul A. Beck & Associates

(57) ABSTRACT

A method for making cable of at least two thermoplastic insulated electrical conductors by thermal bonding. Two electrical conductors are moved into an extruder and are coated independently with heated thermoplastic insulation which maintains concentricity of each conductor with respect to the surrounding insulation. The insulated conductors are held in a spaced relationship until the insulation sets and then the heated insulated conductors are touched together causing the heated insulation to fuse together thereby joining them.

9 Claims, 2 Drawing Sheets

METHOD AND APPARATUS FOR MAKING THERMALLY BONDED ELECTRICAL CABLE

FIELD OF THE INVENTION

This invention relates to a method and apparatus for bonding two separate independent insulated electrical wires together. This is done in a manner that maintains the concentricity of each electrical conductor with respect to the insulation. The invention uses heated thermoplastic material that surrounds each electric conductor. When the insulation has set, the insulated conductors are touched together and are bonded to each other by the heated thermoplastic insulation.

BACKGROUND OF THE INVENTION AND PROBLEM PRESENTED TO INVENTOR

Modern twisted pair cable consists of two separate insulated wires paired through twisting means. Ideally, the insulation of each conductor is applied in such a manner that the concentricity of the conductor with respect to the insulation is maintained. When the conductors are paired, the electrical properties of the cable are maintained at a desirable level.

During installation and handling of the cables, the cables are bent, twisted and stretched, and this changes the geometry of the conductors with respect to each other and it adversely affects critical electrical properties such as attenuation, crosstalk and transmission. In recent years, with improved signal processing speeds and increased data rates, the need for high performance cables, up to 100 mbps, has greatly increased the use of twisted pair cables and has brought to light the importance of these inherent problems.

These installation and handling problems can be eliminated by joining the two conductors together by fusing the pair of conductors along its longitudinal axis, while maintaining each conductor's electrical properties, such that the geometry of the cable cannot change during installation or handling. This will maintain the electrical integrity of the cable.

Post extrusion chemical bonding is one method currently being used to make the cable. A chemical or solvent is applied to the surface of each individually insulated conductor such that, when they are brought into contact with each other and a catalyst is applied, the two separately insulated conductors are fused together. The product of this process is a cable of two insulated conductors joined along an axially extending groove and having desirable electrical properties. This approach offers limited processing speeds which are caused by an additional chemical or solvent application step, and a limited control of bonding characteristics because it is limited to the bond characteristics of the applied chemical or solvent. There also are limited material choices. Many thermoplastics have a very high resistance to some chemicals and solvents, which makes adhesion very difficult or impossible using these thermoplastics.

Another method currently used to negate the problem is parallel extrusion. In this process the two conductors are insulated by extruding the insulation onto the two conductors simultaneously, through the same head and tooling, while they are kept in close proximity to one another, such that the electrical properties of each individual conductor are maintained. The product of this process is a cable of two insulated conductors joined along an axially extending groove and having desirable electrical properties. This approach also offers limited processing speeds because of the nature of the extruder head tools used. It has a limited concentricity control because there is no way to adjust for normal tool wear and pressure variations in the extrudate. It has limited color coding capabilities because using one unmanifolded head limits the number of colors possible.

SUMMARY OF THE INVENTION

The present invention produces a cable of two insulated conductors joined along an axially extending groove and having desirable electrical properties with faster processing speeds, increased concentricity, increased control of bonding characteristics, increased color coding capabilities and increased material choices over the prior art. The present invention is directed to a method and apparatus for producing a pair of individually insulated wires joined by thermal bonding means.

The cable of the present invention includes separate metallic conductors, such as copper, spaced an equal distance from each other in the same plane. Each conductor is concentrically surrounded by an insulating material, such as a thermoplastic elastomer, and the conductors are joined along an axially extending groove such that the geometry of the cable cannot change during further processing and handling, thereby maintaining the electrical integrity of the cable.

In the method of making such a cable, at least two moving electrical conductors are provided in a spaced relationship to one another. The conductors are moved through an extruder means where each is independently coated with a heated thermoplastic electrical insulation material. The independently insulated conductors are kept in a spaced relationship for a period of time to allow the heated insulation on each conductor to set independent of the other conductor. After they are set, the conductors are then brought into touching contact with each other, whereby they are fused and joined by the heated thermoplastic insulating materials surrounding each conductor. The fused conductors are cooled by a cooling means and taken up as a single electrical cable that has been thermally bonded.

In a preferred embodiment of the method, a tension means is applied to uninsulated conductors before they enter the extruder means which equalizes and maintains the tension in the conductors, insuring equal tension on all conductors throughout the system. In the extruder means each conductor is coated independently through separate extruder heads and tooling, or by a single manifolded extruder head with multiple tooling, with a heated thermoplastic electrical insulation, such that the concentricity of the conductor with respect to the surrounding thermoplastic insulation is maintained. The independently coated conductors are brought into touching contact after the thermoplastic coating has set by passing the conductors to a pair of cooled, grooved pinch rolls, by which the coated conductors are joined and fused. The newly joined cable is then cooled by an air and/or liquid quench bath means.

The apparatus of the present invention includes means for providing a first and a second moving uninsulated conductor. The apparatus also includes a tension means for receiving and exiting each conductor and creating equal tension on each conductor as it exits the tension means. An extruder means is included for receiving the conductors from the tension means, the extruder means coating the conductors independently with heated thermoplastic insulation material and in a spaced-apart relationship while maintaining the concentricity of each conductor with respect to the surrounding thermoplastic insulation. The apparatus further comprises means for moving the heated thermoplastic insulated conductors together so as to touch the heated thermoplastic material of each conductor together and join them. The apparatus also includes means cooling the joined thermoplastic insulated conductors.

The present invention for producing a pair of individually insulated wires which are joined by thermal bonding provides significant advantages over the prior art. In particular, the present method allows for increased production and efficiency due to a decrease in the number of steps. There is no chemical or solvent application step. The speed of the system is increased due to the lack of single tooling in the head(s). The method of the present invention offers greater control of concentricity due to an ability to account and adjust for normal tool wear and pressure variations in the extrudate. The present method involves greater control of bonding characteristics due to the lack of solvents. The bond characteristics are set by the amount of tack in each conductor and the pressure supplied to the individual insulated conductors by the pinch rolls and not by the characteristics of a chemical or solvent applied. It is for this reason also that the present process is more environmentally friendly than prior art. There are no hazardous chemicals or solvents added. The method of the present invention offers increased flexibility in color coding through the use of multiple tooling and/or multiple extruders. Furthermore, the present method offers increased flexibility in material choices. Many thermoplastic insulation materials are solvent resistant, thus limiting the number of possible materials. The method of the present invention does not pose this problem.

These and other features of the present invention will be more readily understood from the following description and accompanying drawings.

DETAILED DESCRIPTION OF THE PREFERRED AND ILLUSTRATED EMBODIMENTS

Figure 1:
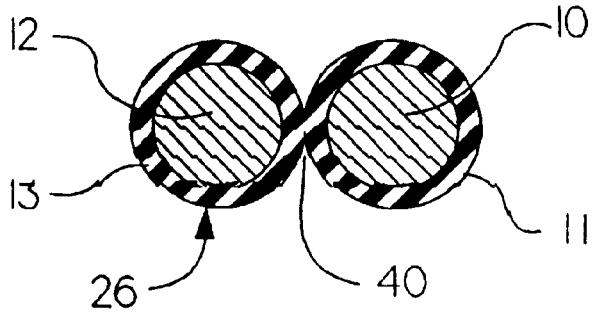
FIG. 1 is a cross-sectional view of a thermally bonded cable produced utilizing the system of the present invention.
Figure 2:
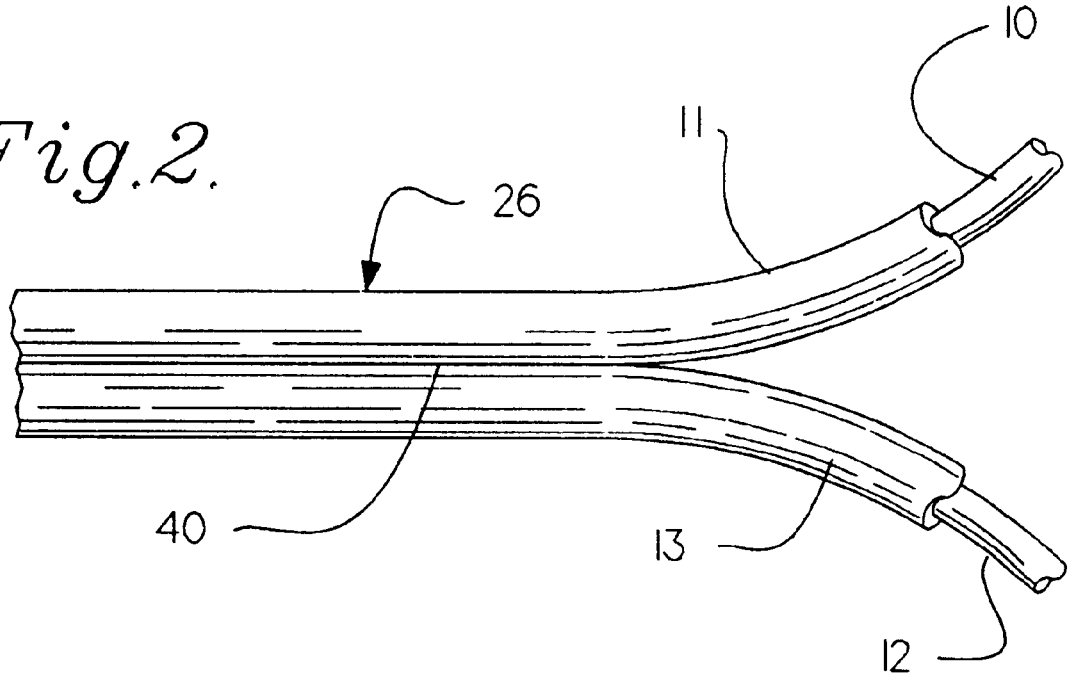
FIG. 2 is a fragmentary plan view of the thermally bonded cable produced utilizing the system of the present invention, showing partial severance along the axially extending groove.

The cable of the present invention comprises separate metallic conductors spaced equal distance from each other and joined to one another with each conductor being concentrically surrounded by a thermoplastic insulating material. FIGS. 1 and 2 illustrate preferred embodiments of the cable produced by the present method and apparatus. The cable, 26, includes two conductors, 10, 12, each individually and concentrically coated with a thermoplastic insulating material, 11, 13, joined along an axially extending groove, 40.

Figure 3:
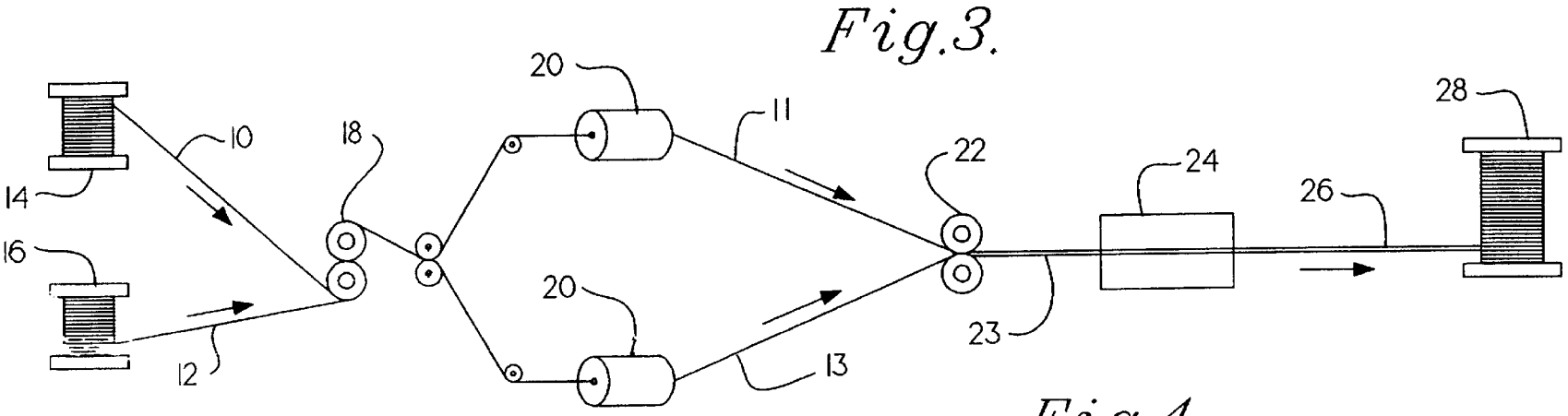
FIG. 3 is a diagrammatical representation of a system for producing the cable of FIGS. 1 and 2, embodying the method and apparatus of the present invention.

FIG. 3 illustrates the production system embodying the present invention, wherein two lengths of bare conductor 10, 12 are continuously withdrawn from supply spools 14, 16 and moved through the system by means not shown. The conductors first pass through a tension equalizing device 18, where the tension of each is equalized with that of the other and maintained throughout the system. Next, the conductors are concentrically coated with a heated thermoplastic insulating material by separate extruder heads and tooling, 20, or a single, manifolded, extruder head and multiple tooling (not shown). Upon exiting the extruder means, the thermoplastic insulated conductors, 11, 13, travel some distance through the air and are allowed to set independent of one another. After setting, the heated insulated conductors are brought to touching contact and fused by grooved, pinch rolls, 22 under conditions which permit the thermoplastic from sticking to the pinch roller by air cooling the pinch rolls. The insulation of the newly fused hot cable, 23, is then cooled and cured by a series of air and/or liquid quench baths, 24. Finally, the completed cable, 26, is wound up on a take up spool, 28.

To create a sufficient bond of the insulated conductors, a tension device, 18, typical of those commercially available from Clipper Machines/Davis-Standard, Pawcatuck, Conn. Model No. TB-16-28, can be utilized. The tension apparatus 18 consists of a series of rubber lined casters with a constant drag means applied to the casters. When two conductors are pulled through the casters, sufficient drag is applied to the casters such that the tension of each conductor is maintained and equal to that of the other. The tension apparatus 18 supplies the necessary tension to the conductors such that the tension is maintained throughout the system, allowing proper bond of the conductors later in the system.

It should be made clear that, although FIG. 3 shows two extruder heads, 20, used to coat the conductors, the same can be accomplished using a single extruder head. The illustrated embodiment of the system in FIG. 3 shows two extruder heads, Genca LT-0130 Series, Genca Corp., Clearwater, Fla., either manifolded from the same extruder machine or from two separate extruder machines. Conceptually, one extruder machine and one extruder head could be used if the extruder head was manifolded, within itself, and used multiple sets of tools, one set for each conductor being coated. A typical extruder that is commercially available is produced by Davis-Standard, Pawcatuck, Conn. Model No. 25-T.

Figure 4:
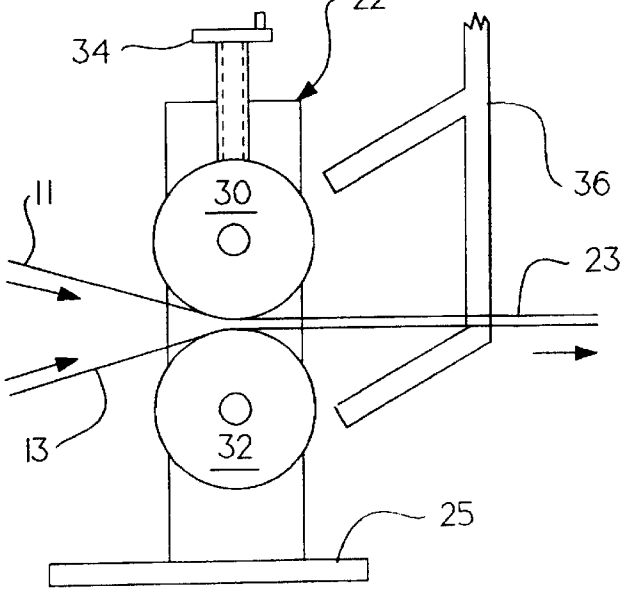
FIG. 4. is a side view of a pinch roll apparatus used in the system of FIG. 3.
Figure 5B:
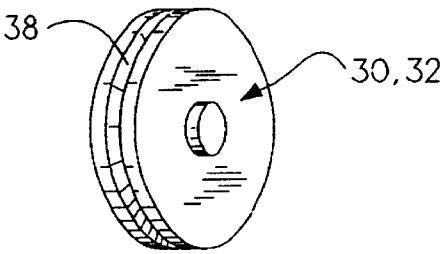
FIGS. 5*a* and 5*b* provide cross-sectional and perspective views of the pinch rolls used in the system of FIG. 3 and the apparatus of FIG. 4.
Figure 5A:
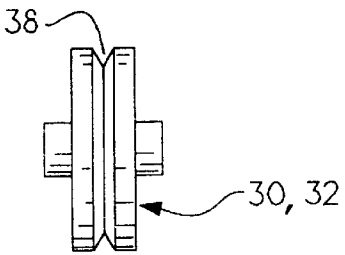

The bonding method used in the present method and apparatus is simple. It uses residual heat in the thermoplastic material from the extruder process to fuse and join the individually insulated conductors. The apparatus is shown in FIGS. 4 and 5. The apparatus accepts the individually thermoplastic coated insulated conductors, 11, 13, to a pair of grooved pinch rolls, 30, 32, where the individual conductors are fused together and exit the apparatus as a single cable, 23. The pinch rolls are pressure sensitive and micrometer adjustable; they adjust for different cable sizes and different bond characteristics. The bottom pinch roll 32 is stationary but the top pinch roll 30 adjusts by means of a spring mounted adjustment knob, 34, located above and connected to the top pinch roll 30. The grooved pinch rolls used, 30, 32, are modified print wheels with grooves 38 machine ground according to the size of cable the rolls are to handle. The basic unit pinch roll stand 25 is a standard Gem Gravure print wheel print stand, this unit and the pinch rolls/print wheels are commercially available from Gem Gravure Comp., Inc., West Hanover, Mass. Model No. AMMCH or can be fabricated if desired.

As illustrated in FIG. 4 and as discussed above, the temperature of the pinch rolls is regulated using cooling means, 36. The pinch rolls are cooled such that, when the warm, individually insulated, independently set conductors come in contact with them, the thermoplastic insulating material does not stick to the pinch rolls 30, 32. The illustrated embodiment in FIG. 4 shows cooling by air 36. However, any cooling means which accomplishes the same result would suffice in the system of the present invention.

It should be noted that the distance in air between the extruder means 20 and the bonding means (pinch rolls 22) is a function of the speed of the machine, the temperature of the extrudate and the melt characteristics of the thermoplastic insulation material used. The distance is such that, the individual thermoplastic insulated conductors are allowed to set independent of each other while maintaining sufficient residual heat to allow for bonding in the bonding means. Generally, the higher the extruder speed, the greater the distance between the extruder means 20 and the bonding means (pinch roll 22). The illustrated embodiment of the present invention involves a distance between the extruder means 20 and the bonding means (pinch rolls 22 and 32) of 15–20 feet.

Following the joining of the conductors, the newly fused cable 23 is fully set using cooling means 24 (FIG. 3). The cooling means 24 cures and sets the thermoplastic insulating material by cooling it, such that the size and shape of the insulating material are secured prior to further handling and packaging. Preferred embodiments of the present invention use a combination of air and forced cooling, liquid quench bath. Depending on the set characteristics desired, the system could include more or less of each type of cooling, or, the system could include any other cooling means which produces the same result.

Although, as has been emphasized hereinabove, the present method and apparatus will be used mostly in the production of two-conductor, paired cable, the present invention allows for the bonding of more members if needed. Conceptually, with the correct groove depth and adequate cooling in the pinch rolls, the number of conductors bonded is only limited by space considerations.

We claim:

1. A method for making high frequency cable of at least two electrical conductors with each conductor insulated by thermoplastic material which concentrically surrounds each respective conductor comprising:

(a) providing a first uninsulated electrical conductor;

(b) providing a second uninsulated electrical conductor;

(c) moving both conductors into an extruder means which coats each conductor separately and independently with a heated thermoplastic electrical insulation material, the extruder means maintains the concentricity of each conductor with respect to the surrounding thermoplastic insulation and in a spaced relationship from the adjacent insulated conductor;

(d) moving the conductors which have been coated with heated thermoplastic material from the extruder means and in a spaced relationship so as to permit the thermoplastic material on each conductor to set independent and separate of the other conductor; and (e) bringing the conductors into touching contact after the thermoplastic material has set while using only residual heat from the extruding means, whereby the coated conductors are fused and joined together by the heated thermoplastic materials surrounding each conductor, the set is achieved whenever the thermoplastic retains its concentricity upon contact with adjacent thermoplastic of the adjacent conductor while retaining tack.

2. A method as recited in claim 1 including maintaining the tension of the two conductors moving into the extruder means identical.

3. A method as recited in claim 1 wherein the extruder means comprises separate extruder heads, one for each conductor.

4. A method as recited in claim 1 wherein extruder means comprises a single, manifolded head capable of coating each conductor separately.

5. A method as recited in claim 1 wherein the conductors are brought together by passing the conductors to a pair of pinch rolls.

6. A method as recited in claim 5 wherein the pinch rolls are cooled.

7. A method as recited in claim 5 wherein the pinch rolls are grooved.

8. The method as recited in claim 1 including cooling the pair of joined electrical insulated conductors.

9. A method as recited in claim 8 wherein the cooling step is by quenching the insulated conductors in a liquid bath.

* * * * *